US005188719A

United States Patent [19]

Akanuma et al.

[11] Patent Number: 5,188,719

[45] Date of Patent: Feb. 23, 1993

[54] ELECTROLYTIC PROCESSING SYSTEM

[75] Inventors: Masaaki Akanuma, Saitama; Akira Hasegawa, Toyama, both of Japan

[73] Assignee: Yoshida Kogyo K. K., Tokyo, Japan

[21] Appl. No.: 757,643

[22] Filed: Sep. 11, 1991

[30] Foreign Application Priority Data

Sep. 11, 1990 [JP] Japan ..... 2-238995

[51] Int. Cl.[5] ..... C25D 17/00

[52] U.S. Cl. ..... 204/206

[58] Field of Search ..... 204/206

[56] References Cited

U.S. PATENT DOCUMENTS

| | | | |
|---|---|---|---|
| 2,271,735 | 2/1942 | Hall . | |
| 3,634,223 | 1/1972 | Carter | 204/206 |
| 4,500,400 | 2/1985 | Komoda | 204/206 |
| 4,948,487 | 8/1990 | Imazu | 204/206 |

FOREIGN PATENT DOCUMENTS 1510512 1/1968 France .

OTHER PUBLICATIONS

Patent Abstracts of Japan, vol. 8, No. 114 (C225) (1551) May 26, 1984, & JP-A-59 025 997 (Kawasaki Seitetsu KK) Feb. 10, 1984.

*Primary Examiner*—T. M. Tufariello

*Attorney, Agent, or Firm*—Hill, Steadman & Simpson

[57] ABSTRACT

An electrolytic processing system performs a continuous electrolytic process to discrete conductors such as metal coupling elements of a slide fastener chain or conductive objects having a large electrical resistance. In the electrolytic processing system, an object is electrolytically processed while it is guided between intermediate rollers and arc electrodes.

11 Claims, 4 Drawing Sheets

ELECTROLYTIC PROCESSING SYSTEM

BACKGROUND OF THE INVENTION

1. Field of the Invention

This invention relates to an electrolytic process system, which continuously performs an electrolytic process such as plating, anode oxidation or coloring to discrete conductors such as a slide fastener chain which includes metal coupling elements embedded on fastener tapes or conductors such as carbon strips having a large electrical resistance.

2. Description of the Related Art

There are currently known a number of systems for continuously performing an electrolytic process such as plating to continuous conductors such as metal strips.

As shown in FIG. 6 of the accompanying drawings, one of such known systems comprises an electrolytic bath 1, an intermediate roller 2 having a large diameter, an arc electrode 3, and a pair of feeding rollers 4. The intermediate roller 2 and the arc electrode 3 are disposed in the electrolytic bath 1 in a confronting manner. The feeding rollers 4 are positioned above the intermediate roller 2 on opposite sides thereof. The arc electrode 3 is connected to the anode of a power supply, and the feeding rollers 4 are connected to the cathode of the power supply. A conductor 5 is guided via one of the feeding rollers 4, the intermediate roller 2 and the other feeding roller 4. Then, the cathode current is applied to the conductor 5 from the feeding rollers 4. When passing between the intermediate roller 2 and the arc electrode 3, the conductor 5 has continuously applied a plating liquid ejected from nozzles of the arc electrode 3.

With this type of electrolytic processing system, the cathode current is applied to an object to be processed from the pair of feeding rollers 4. If the object is a continuous conductor such as a metal strip, the cathode current can be continuously applied to the object while it passes through the space between the intermediate roller 2 and the arc electrode 3. However, with discrete conductors such as a slide fastener chain 8 having metal coupling elements 7 embedded thereon as shown in FIG. 7, no cathode current can be applied to any part of the discrete conductors passing between the intermediate roller 2 and the arc electrode 3, thereby preventing the conductors from being plated.

Since the feeding rollers 4 are located far from the arc electrode 3, the cathode current is still applied from the feeding rollers 4 to the object at a portion which is passing through the space between the intermediate roller 2 and the arc electrode 3. When the object is a conductor such as a carbon strip having a large electrical resistance, the amount of cathode current is reduced since heat is generated by the current flow in the object. Therefore, a large cathode current must be to be applied to overcome such inconvenience, which means an increase in power consumption and a decrease in processing efficiency.

SUMMARY OF THE INVENTION

It is therefore an object of this invention to provide an electrolytic processing system which can overcome the above inconveniences.

According to this invention, there is provided an electrolytic processing system comprising: a plurality of cylindrical intermediate rollers mounted in an electrolytic bath, each of the intermediate rollers being rotatably supported on a vertical shaft and being capable of applying a current; a plurality of arc electrodes mounted in the electrolytic bath and positioned in a manner so as to confront part of outer circumferential surfaces of the intermediate rollers, each of the arc electrodes including nozzles for ejecting a processing liquid; and means for guiding the objects to be processed on each of the intermediate rollers through an area thereof where each of the intermediate rollers confronts each of the arc electrodes.

The current applied to the intermediate rollers is applied to the object to be processed when it is in contact with the intermediate roller. No current flows to any portion of the object which is passing between the intermediate roller and the arc electrode to be electrolytically processed. Therefore, not only discrete conductors can undergo electrolytic process but also objects having a large electrical resistance such as carbon strips can be efficiently processed without using an excessively large current, since no current is applied to the object at a portion which is being electrolytically processed.

DETAILED DESCRIPTION

An electrolytic processing system according to one embodiment of this invention will be described with reference to FIGS. 1 to 5.

Figure 1:
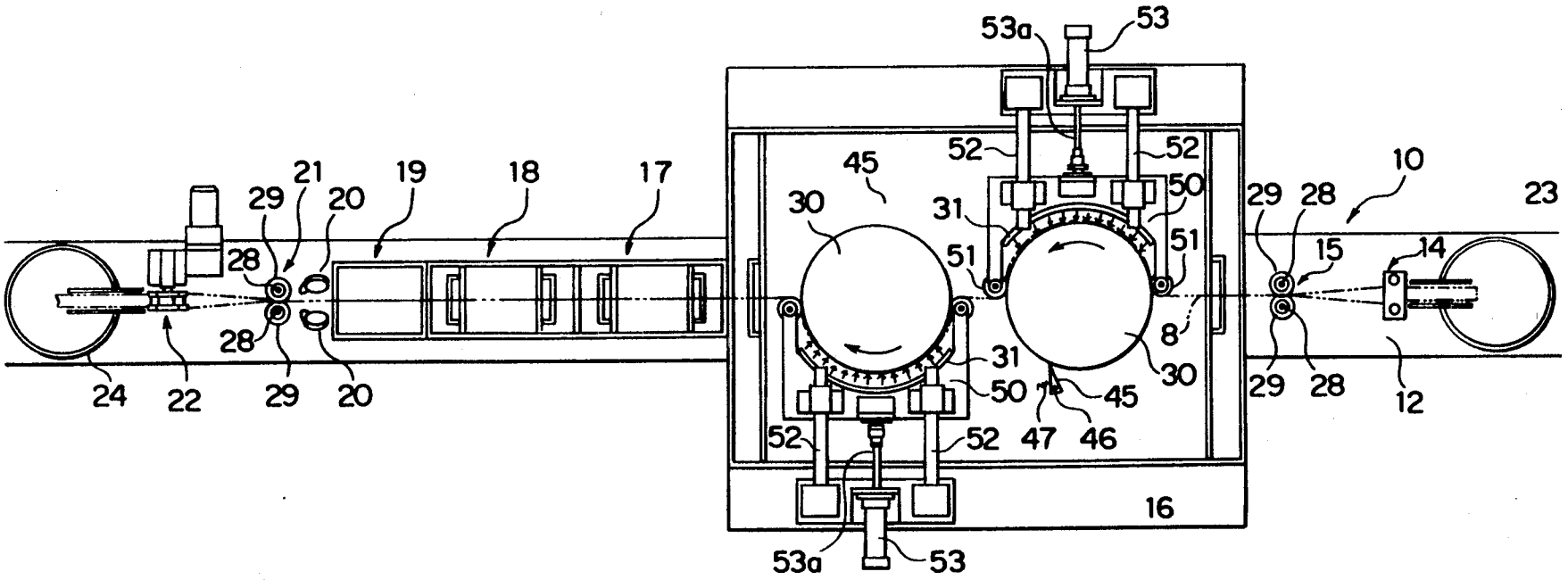
FIG. 1 is a plan view of an electrolytic processing system according to one embodiment of this invention.
Figure 2:
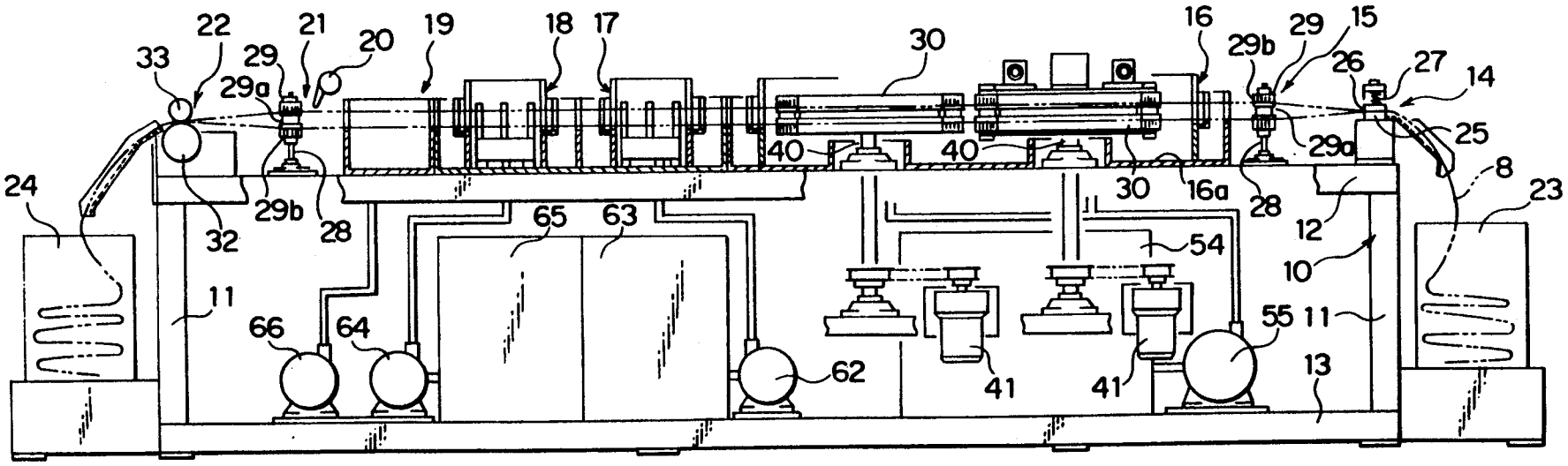
FIG. 2 is a front view of the electrolytic processing system of FIG. 1.

FIGS. 1 and 2 shows an electrolytic processing system for nickel-plating steel coupling elements 7 of a slide fastener chain 8. The coupling elements 7 are discrete conductors which need to be processed.

As shown in FIGS. 1 and 2, the electrolytic processing system comprises a frame 10, which includes braces 11, and upper and lower horizontal members 12, 13. A brake 14, a guide 15, an electrolytic bath 16, a recovery bath 17, a rinsing bath 18, a vacuum drying unit 19, a dryer 20, a guide 21, and a feed roller 22 are mounted on the upper horizontal member 12 in this order. A box 23 for housing objects to be processed and another box 24 for storing the processed objects are positioned at opposite ends of the frame 10.

The brake 14 has a stationary member 25 and a movable pusher piece 24 urged against to the stationary member 25 by a spring 27, horizontally holding the object to be processed, e.g. a slide fastener chain 8 in this embodiment.

The guides 15, 21 resepectively include two pairs of rollers 29 rotatable about respective vertical shafts 28, thereby guiding the slide fastener chain 8 so that the slide fastener chain 8 is kept vertical between the electrolytic bath 16 and the dryer 20.

The electrolytic bath 16 includes a pair of intermediate rollers 30 and a pair of arc electrodes 31, which are positioned in a confronting manner. The slide fastener chain 8 is guided between one of the intermediate rollers 30 and one of the arc electrodes 31 so that one surface of the coupling elements 7 of the slide fastener 8 is plated. Then, the other surface of the coupling elements 7 is similarly plated while passing through the other intermediate roller 30 and the other arc electrode 31.

The plated slide fastener chain 8 is removed from the electrolyte in the recovery bath 17, and is then rinsed in the rinsing bath 18, vacuum-dried in the vacuum drying unit 19, dried by the drier 20, sandwiched in a nip between a drive roller 32 and a pinch roller 33 of the feed roller unit 22 with a predetermined force, and received in the box 24.

The slide fastener chain 8 is guided at a predetermined tension by the feed roller unit 22 and the brake 14.

The rollers 29 of the guides 15, 21 have central small diameter portions 29*a*. The coupling elements 7 of the slide fastener chain 8 fit into the small diameter portions 29*a* and make fastener tape 6 contact with large diameter portions 29*b* of the rollers 29, so that the slide fastener chain 8 comes into uniform contact with the rollers 29.

In FIG. 2, reference numeral 62 represents a pump for recovering the electrolyte from the electrolyte bath 17 and returning it to a tank 63; and 64, a pump for supplying water from a tank 65 to the rinsing bath 18; and 66, a vacuum pump.

The following is a detailed description of the intermediate rollers 30 and the arc electrodes 31.

Each of the intermediate rollers 30 is a cylindrical member made of stainless steel, and is rotatable in a horizontal plane about a vertical shaft 40. The vertical shaft 40 is set in motion by a motor 41 mounted on the lower horizontal member 13 of the frame 10, being connected to the cathode of the power supply in order to apply the cathode current to the intermediate roller 30.

Figure 3:
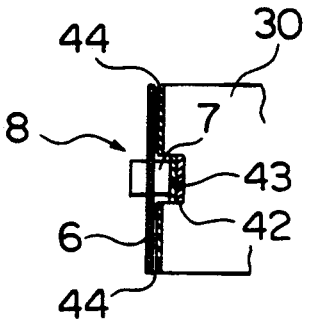
FIG. 3 is an enlarged view of an outer circumferential surface of an intermediate roller.

As shown in FIG. 3, an annular groove 42 is formed on the central portion of the intermediate roller 30. A ring-like conductive layer 43 is mounted in the annular groove 42 to receive the cathode current. The whole of the surface of the intermediate roller 30 except for the annular groove 42 is covered with insulating layers 44 made of synthetic resins such as plastics, urethane, or rubbers. Therefore, the coupling elements 7 of the slide fastener chain 8 fit into the annular groove 42 so as to come into contact with the conductive layer 43 and receive the cathode current. On the other hand, the fastener tapes 6 contact with the insulating layers 44 to prevent the application of the plating liquid.

Although on the whole, the intermediate roller 30 is conductive, it is actually conductive at its annular groove 42 where the coupling elements 7 of the slide fastener chain 8 are contacted, and is nonconductive in other areas.

Therefore, the electrolytic film such as the plating layer is only applied to the object to be processed, thereby guiding and carrying the processed object without any inconvenience since electrolyte film seldom sticks to the outer circumferential surface of the intermediate roller 30.

Even when the intermediate roller 30 is constructed as described above, a little electrolyte occasionally sticks to the surface of the intermediate roller 30. Therefore, means such as a scraper 45 is normally urged against the intermediate roller 30 at a portion opposite to the arc electrode 31 to scrape the electrolyte from the intermediate roller 30.

Figure 4:
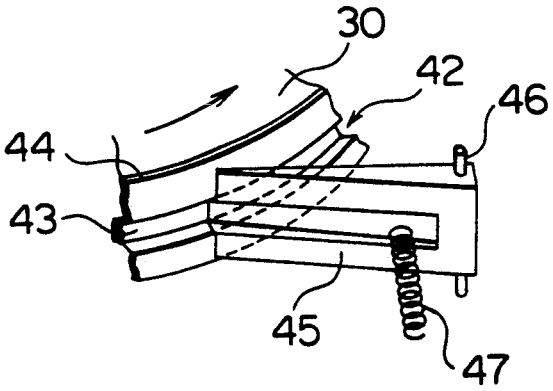
FIG. 4 is a perspective view of a scraper.
Figure 5:
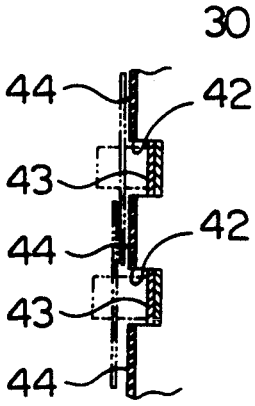
FIG. 5 shows an outer circumferential surface of a modified intermediate roller.
Figure 6:
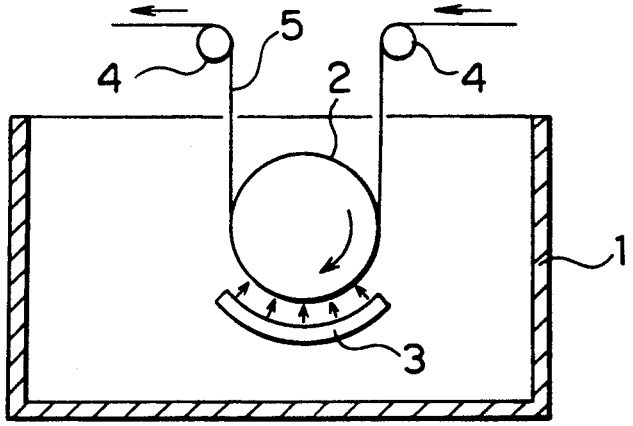
FIG. 6 PRIOR ART
FIG. 6 shows a prior art electrolytic processing system.
Figure 7:
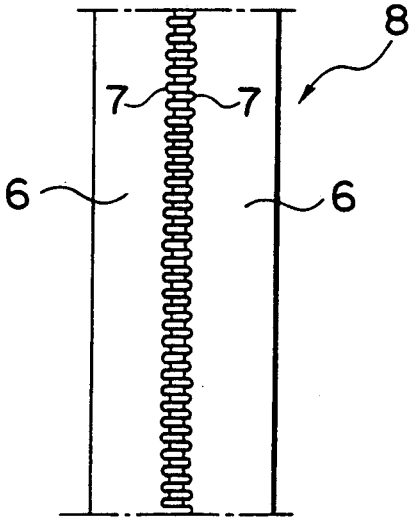
FIG. 7 is a front view of a slide fastener chain.

As shown in FIG. 4, the scraper 45 whose cross-sectional shape is identical to the shape of the outer circumferential surface of the intermediate roller 30 is movably supported by a pin 46. The scraper 45 is biased by a spring 47 so that the tip of the scraper 45 is in contact with the outer circumferential surface of the intermediate roller 30.

The electrolyte may be removed not only by the scraper but also by a rotatable brush or a mechanism for chemically or electrically dissolving the plated film, for example.

An electrolytic scraping method is conceivable as a means for electrically dissolving the plated layer.

An additional bath may be disposed in the electrolyte bath 16 to be in partial contact with the intermediate roller 30. This bath 16 is filled with a scraping liquid, which is applied the cathode current in order to dissolve the plating film which still adheres to the outer circumferential surface of the intermediate roller 30.

Each of the arc electrodes 31 is mounted on a support 50 with a pair of pressure rollers 51. The arc electrode 31 is horizontally movable to and from the intermediate roller 30 along a pair of guide levers 52. A piston lever 53*a* of a cylinder 53 is extended to move the arc electrode 31, the pressure rollers 51 and the support 50 toward the intermediate roller 30. The pressure rollers 51 press the slide fastener chain 8 against the outer circumferential surface of the intermediate roller 30. Then, the slide fastener chain 8 is brought into uniform contacts with the intermediate roller 30 and is brought to the region where the intermediate roller 30 and the arc electrode 31 confront each other. After this, the piston lever 53*a* is retracted to move the arc electrode 31 and the pair of pressure rollers 51 away from the intermediate roller 30. Thereafter, the slide fastener chain 8 can be easily wound around the outer circumferential surface of the intermediate roller 30.

The arc electrode 31 has on its one side a plurality of nozzles for ejecting a processing liquid such as a nickel-plating liquid toward the circumferential surface of the intermediate roller 30. The arc electrode 31 is connected to the anode of the power supply in order to receive the anode current.

Specifically, the arc electrode 31 is a hollow member, having the nozzles which are equally spaced on the side confronting the intermediate roller 30. The processing liquid, e.g. a nickel plating liquid, is supplied into the arc electrode 31 from the tank 54 by the pump 55.

The arc electrode 31 applies the anode current and so supplies the plating liquid to the circumferential surface of the intermediate roller 30. The plating liquid is sprayed onto the coupling elements 7 of the slide fastener chain 8 to which the cathode current has been applied. Thus the coupling elements 7 are nickel-plated. The plating liquid falls down along the surface of the intermediate roller 30, gathering in a reservoir 16*a* of the electrolyte tank 16, and is then discharged by a pump.

In the foregoing embodiment, one slide fastener chain 8 as the object to be processed is wound on the central portion of the intermediate roller 30. However, it is also possible to form a plurality of annular grooves 42 on the intermediate roller 30, and to wind a plurality of slide fastener chains 8 on the intermediate roller 30 with the fastener tapes 6 overlapping one another.

The nickel plating liquid is exemplified in the foregoing embodiment. The object can however be processed by another plating method by simply changing the plating liquid. This invention is also applicable to anode oxidation or electrolytic coloring by changing the polarity of the current to be applied, or by changing the plating liquid.

According to this invention, since the current is applied to the intermediate roller 30 for guiding the object to be processed, the object comes into contact with the intermediate roller 30 to receive the current. Therefore no current is applied to the object at its portion which is between the intermediate roller 30 and the arc electrode 31. Therefore, not only discrete conductors but also objects such carbon strips having a large electrical resistance can undergo the electrolytic process. Since no current is applied to the areas where such electrolytic process is not required, and since no heat is generated by the flowing current, the current to be applied can be reduced.

Since the intermediate roller 30 is rotated in the horizontal plane about the vertical shaft 40, the plating liquid sticking to the surface of the intermediate roller 30 falls down by its own weight, and does not adversely affect transportation of the processed object.

Since the current is applied only to the area where the object to be processed is in contact with the intermediate roller 30, an electrolytic film will be formed only on the necessary area of the object.

Even if there is an electrolytic film on the intermediate roller 30, this film can be removed so as to enable the object to be carried reliably.

Although various minor changes and modifications might be proposed by those skilled in the art, it will be understood that we wish to include within the claims of the patent warranted hereon all such changes and modifications as reasonably come within our contribution to the art.

What is claimed:

1. An electrolytic processing system for continuously performing an electrolytic process to discrete conductors or conductive objects having a large electrical resistance, comprising:

(a) a plurality of cylindrical intermediate rollers mounted in an electrolytic bath, each of said intermediate rollers being rotatable in a horizontal plane about a vertical shaft and being capable of applying a current;

(b) a plurality of arc electrodes mounted in said electrolytic bath and positioned in a manner so as to confront part of outer circumferential surfaces of said intermediate rollers, each of said arc electrodes including nozzles for ejecting a processing liquid; and (c) means for guiding the objects to be processed on each of said intermediate rollers through an area thereof where each of said intermediate rollers confronts each of said arc electrodes.

2. An electrolytic processing system according to claim 1 wherein part of the outer circumferential surface of each of said intermediate rollers is conductive and a remaining portion of each of said intermediate rollers is non-conductive, the discrete conductor or conductive object having a conductive surface which is in electrical contact with and extends at least as wide as said conductive portion.

3. An electrolytic processing system according to claim 1 further including scraping means for removing processing liquid sticking on the outer circumferential surface of each of said intermediate rollers, said scraping means being located on each of said intermediate rollers at an area opposite to an area where each of said intermediate rollers confront each of said arc electrodes.

4. An electrolytic processing system according to claim 1 wherein each of the cylindrical intermediate rollers has at an outer peripheral surface thereof an annular groove containing at a bottom thereof a ring-like conductive layer for cathode current, and flanking the annular groove at both sides thereof insulating layers on said outer peripheral surface of said intermediate rollers, and wherein a width of said annular groove is selected to accommodate a conductive portion of the discrete conductor or conductive object, and the insulating layers being dimensioned to be in contact with insulated portions of said discrete conductor or conductive object flanking the conductive portions thereof and which are not to be electrolytically processed.

5. An electrolytic processing system according to claim 1 wherein one of said intermediate rollers in said electrolytic bath is arranged to be in electrical contact with one surface side of said discrete conductor or conductive object lying along a vertical plane and the other intermediate roller in said same electrolytic bath is arranged to be in electrical contact with an opposite surface side of said discrete conductor or conductive object.

6. An electrolytic processing system for continuously performing an electrolytic process to a strip-like conductive object having opposite conductive surfaces, comprising:

a first cylindrical intermediate roller mounted in an electrolytic bath and being rotatable in a horizontal plane about a vertical shaft and being capable of applying a current;

a second intermediate roller mounted in said same electrolytic bath and also being rotatable in a horizontal plane about a vertical shaft and being capable of applying a current;

said first and second rollers being positioned such that the first roller is in electrical contact with a first electrically conductive surface side of said strip-like object and the second roller is in electrical contact with an opposite second conductive side of said strip-like object; and electrode means arranged alongside a peripheral surface of each of said intermediate rollers for transferring an electrical current to said respective intermediate roller.

7. An electrolytic processing system for continuously performing an electrolytic process to a strip-like object having a central electrically conductive portion and flanking portions on which it is not desired to perform an electrolytic process, comprising:

at least one cylindrical intermediate roller mounted in an electrolytic bath; and said roller having a conductive band portion which is slightly wider than a width of the central conductive portion of said strip-like object, and flanking insulating portions at a peripheral surface of the intermediate roller alongside the band portion at both sides thereof for contact with said flanking portions of said object where it is not desired to perform an electrolytic process.

8. A system according to claim 7 wherein an annular groove is provided in said intermediate roller, a bottom portion of said groove having said electrically conductive band therein, and said insulating layers flanking said groove.

9. A system according to claim 8 wherein said object comprises a slide fastener having metallic coupling elements flanked by outer insulating fastener tape which is not to be electrolytically processed.

10. A system according to claim 7 wherein said intermediate roller rotates in a horizontal plane about a vertical shaft such that a peripheral surface thereof lies in a vertical plane and the strip-like object thus also lies in a vertical plane when in electrical contact with said intermediate roller.

11. A system according to claim 10 wherein two of said intermediate rollers are provided, each being mounted about a vertical shaft for rotation in a horizontal plane, both of said rollers being in said same electrolytic bath, and one of the rollers being positioned for electrolytically processing one side surface of the object and the other intermediate roller being located for electrolytically processing the opposite side surface of the strip-like object, both side surfaces lying parallel to a vertical plane.

* * * * *